US006625913B1

(12) United States Patent
Prade

(10) Patent No.: US 6,625,913 B1
(45) Date of Patent: Sep. 30, 2003

(54) PICTURE-FRAME

(75) Inventor: Ernstfried Prade, Herzogstr. 1, D-86981 Kinsau (DE)

(73) Assignee: Ernstfried Prade, Kinsau (DE)

( * ) Notice: Subject to any disclaimer, the term of this patent is extended or adjusted under 35 U.S.C. 154(b) by 0 days.

(21) Appl. No.: 09/869,558

(22) PCT Filed: Jan. 12, 2000

(86) PCT No.: PCT/DE00/00085

§ 371 (c)(1),
(2), (4) Date: Jul. 12, 2001

(87) PCT Pub. No.: WO00/41601

PCT Pub. Date: Jul. 20, 2000

(30) Foreign Application Priority Data

Jan. 12, 1999 (DE) ..... 199 00 836
Feb. 1, 1999 (DE) ..... 199 03 908

(51) Int. Cl.[7] ..... A47G 1/06
(52) U.S. Cl. ..... 40/738; 40/650
(58) Field of Search ..... 40/738, 739, 741, 40/743, 790, 791, 650, 658

(56) References Cited

U.S. PATENT DOCUMENTS

| | | | | |
|---|---|---|---|---|
| 1,762,675 A | | 6/1930 | Wiener | |
| 2,428,772 A | | 10/1947 | Aranoff | |
| 2,489,089 A | * | 11/1949 | Graff et al. | 40/650 |
| 2,507,937 A | * | 5/1950 | Slavsky et al. | 40/650 |
| 2,608,777 A | * | 9/1952 | Schuler | 40/650 |
| 2,812,600 A | * | 11/1957 | Hopp | 40/650 |
| 2,815,597 A | | 12/1957 | Carter | |
| 2,895,241 A | * | 7/1959 | Ferdinand et al. | 40/650 |
| 2,935,804 A | * | 5/1960 | Duckro | 40/650 |
| 3,846,925 A | | 11/1974 | Busse | |
| 4,011,672 A | * | 3/1977 | Grusin | 40/650 |
| 4,334,372 A | * | 6/1982 | Colmar | 40/650 |

FOREIGN PATENT DOCUMENTS

| | | |
|---|---|---|
| CH | 310 672 | 1/1956 |
| CH | 613 107 A5 | 9/1979 |
| DE | 26 50 201 A1 | 5/1977 |
| DE | 195 06 049 A1 | 11/1995 |
| DE | 298 150 009 U1 | 12/1998 |
| FR | 1 533 457 | 7/1968 |
| FR | 2 683 653 | 5/1993 |
| GB | 364 167 | 1/1932 |

* cited by examiner

*Primary Examiner*—William Miller
(74) *Attorney, Agent, or Firm*—Oliff & Berridge, PLC

(57) ABSTRACT

A display body or picture frame wherein an image or a retainer panel supporting the image is received between two retainer sections formed at a rear bracket and pre-tensioned against a rear support, so that the image is clamped in a concave configuration towards the viewer.

9 Claims, 9 Drawing Sheets

PICTURE-FRAME

BACKGROUND OF THE INVENTION

The invention relates to a picture frame or a display body.

It is known to display images, for example photographs, pictures, posters, art prints or the like by mounting them in a frame and then hanging them on the wall or placing them on a planar surface with the aid of the frame which supports itself on this surface. Apart from the customary wood, plastic or metal frames whereby images may be mounted and hung or placed, it is also known to use so-called frameless picture holders, wherein the image is held between a back panel of pressboard or the like and a front glass sheet with the aid of springy brackets and is thus displayed.

All of these known devices for displaying images have in common that the image is held planar, i.e., flat or even. In such known devices, replacing the held image is comparatively troublesome. In the case of mounted images hung on the wall, the entire frame must always be taken off the wall. Then the picture must be removed from the frame. In the case of frameless picture holders the metal brackets must be released so as to gain access, after lifting off the glass sheet, to the image located behind it. In the case of frames that may be placed on even surfaces, for example on desktops, posterior retaining means must be removed or released so as to be able to take off the back panel from the frame. When inserting a new picture, such as a photograph, care must often be taken for the picture to be positioned correctly, i.e. straight and centered, in a so-called passe-partout encompassing the picture in addition to the frame. Finally in known devices for displaying images, i.e. wall or desktop frames, the design facilities for fashioning the frame are limited. Although it is possible to apply fashioning activities to a certain extent with the aid of various materials, moldings and colors for picture frame slats, these facilities nevertheless are limited.

From CH 613 107 a device for displaying images is known where the images are received in a three-dimensional casing. The casing has an opening which encompasses a panel carrying the images along the outer circumference thereof. The distance of the circumferential edges of the recess is selected such that the panel and thus the images flex towards the inside, into the casing.

Such a device has a very voluminous structure which does not meet high esthetic standards. It is furthermore a drawback that the known device is merely suited for a predetermined rectangular formats panels or pictures deviating from the rectangular shape or having a larger size cannot be accommodated. On account of the voluminous structure, the known device is furthermore not suited for hanging on walls.

In DE 195 06 049 A1 a frame is shown whereby an image convexly flexing towards the viewer is received. With such a convex flexure, the three-dimensional effect directed towards the viewer which may be created in the above described construction cannot be achieved. As the frame encompasses the image or the retainer panel along the lateral edges, it is also suited for predetermined geometries and dimensions only.

SUMMARY OF THE INVENTION

In contrast, the invention is based on the object of furnishing a picture frame or a display body permitting to display images in various formats and with an appealing esthetic impression.

This object is achieved through a picture frame having the features of the claims.

In accordance with the invention, the image or a retainer panel carrying the image is braced and subjected to a pre-stress through a rear bracket or means acting in a similar manner, so that the image or the retainer panel, respectively, is held in a concavely curved condition. The bracket only acts on the image or retainer panel via two retainer noses or projections, so that geometries differing from the rectangular shape—for instance an oval shape—and other picture formats may reliably be accommodated. Support is affected via the two retainer sections only. Apart from that the bracket is arranged behind the image, the picture frame retreats into the background in relation to the image, thereby creating the impression of the image being received free-floating, detached from the fastening wall. This is enhanced by the image being concavely curved in a direction towards the viewer.

The solution according to the invention permits to support the image with minimum expenditure in terms of device technology, for essentially only the bracket having the two retainer sections must be formed, whereas in the prior art described at the outset, voluminous frame constructions are necessary.

The design according to the invention moreover makes it possible to exchange pictures by the so-called snap-in method, in which the picture is initially inserted into the retainer bracket in a configuration convexly flexing towards the viewer, and by application of a tensioning force on the apex of the flexure, the image reverses and enters into contact with the posterior support, so that a reliable three-point clamping of the image is effected. This makes it possible to also employ the solution according to the invention for calendars etc. which require periodical replacement of the pictures.

Advantageous developments of the invention are subject matters of the subclaims. It should furthermore be noted here that in the following description, the term "image" encompauses both a picture only and also an image arranged in a planar configuration between the two retainer panels, which is then immobilized on the display body with the aid of these retainer panels.

The retainer sections preferably hold the picture along one line each, so that locally limited stresses on the image's lateral edges with possible permanent deformations are avoided. Moreover due to the linear contact of the retainer sections on the image, their uniform flexure is ensured better.

In a particularly preferred manner, supporting the image is accomplished at its back side in the range of the flexure on at least one supporting edge extending between two lateral edges of the image. This ensures better mounting of the image in comparison with a point-type support.

In a particularly preferred manner, supporting the image is accomplished on two supporting edges extending at a spacing between the two lateral edges of the image. These supporting edges may extend either in parallel to each other, or in turn may each have an arcuately curved development originating at the retainer sections at the image or ending there, respectively, i.e. in the form of an extremely long-drawn ellipse inn the top view. In either case the result is a reliable support of the image relative to the display body and a lasting sustainment of the desired flexure. Forces laterally acting on the image, for example air currents owing to drafts or the like, cannot cause the image to "flutter" on the display body when it is supported at two supporting edges.

The supporting edges are preferably defined by folds on the display body, with these folds moreover preferably being formed through deliberate deformations of the display body. The supporting edges are thus, as it were, formed integrally on the display body, so that no further production or assembling steps are required for their formation.

If the spacing between the opposed retainer sections is variable, advantageously a specific adaptation to the respective size of the image to be immobilized may be performed.

As a material for producing the display body a multitude of possibilities are conceivable, for example cardboard and here in particular corrugated cardboard or plastic, metal, wood, or any combinations thereof.

In accordance with another preferred embodiment, there is the possibility of placing in front of the image a clear protective sheet which substantially matches the flexure of the image and may also be immobilized at the retainer sections of the display body. Such protective sheet of a clear, flexible material, for example a corresponding plastic, on the one hand has the purpose of protecting the image against soiling by dust, fingerprints or the like, and may moreover be used by correspondingly selecting a material to protect the image against yellowing due to UV exposure. Moreover such a protective sheet advantageously serves to maintain the flexure of the image, particularly in co-operation with the point-type or linear support of the image in the range of its back side, as was already mentioned further above.

Finally the flexure of the image and optionally of the protective sheet preferably has a radius of curvature which corresponds to about 2 to 3 times the length of the long side of the image. Practical experimentation has shown that radii of curvature situated in this range generate a particularly appealing effect on the viewer for images having a customary size.

BRIEF DESCRIPTION OF THE DRAWINGS

Further aspects and advantages of the present invention are evident from the following description of several embodiments by referring to the drawing, wherein.

DETAILED DESCRIPTION OF EXEMPLARY EMBODIMENTS

Figure 1:
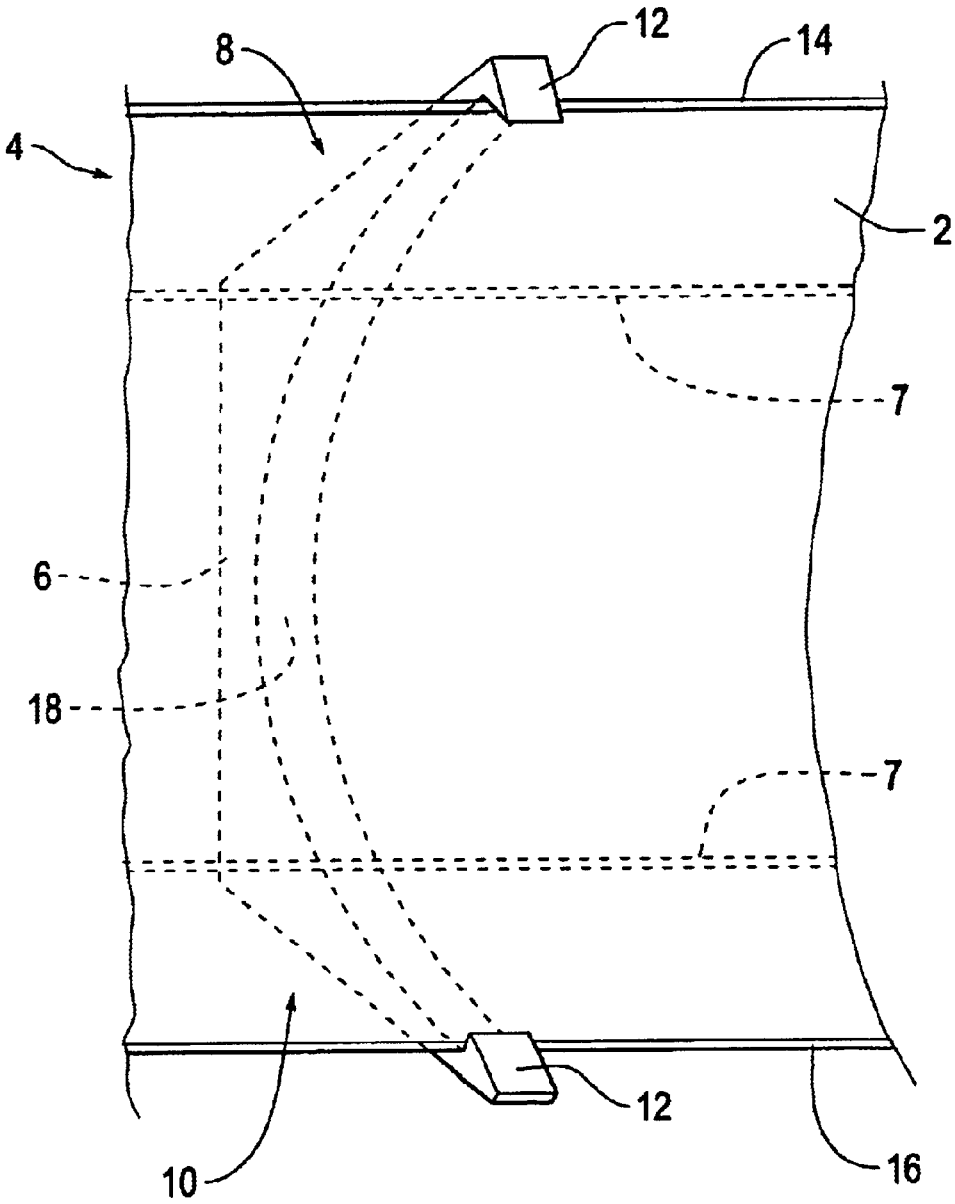
FIG. 1 is a schematic representation for explaining the underlying principle of the present invention.

FIG. 1 schematically shows the underlying principle of the present invention, of how an image 2, for example a photograph, picture, poster, art print, calendar or the like may be fastened to a device altogether designated by 4. In the represented embodiment, the device 4 presents a bracket 6 having a substantially arcuate curvature and having, at the two free ends of its legs 8 and 10, retainer noses or projections which serve as retainer sections 12. The retainer sections 12 clasp two opposite lateral edges 14 and 16 of the image 2 in the manner seen in FIG. 1. Herein a spacing between the two retainer sections 12 is smaller than the distance between the two lateral edges 14 and 16, so that the image 2 is subjected to a flexure between the two lateral edges 14 and 16. The back side of the image 2 is thus in FIG. 1 flexed to the rear towards the bracket 6 and supported substantially along a surface 18 of the bracket 6 having an arcuate curvature. The image is thus clamped between the retainer sections 12 and the rear support, and remains in the concave position. Instead of the one bracket 6 in accordance with FIG. 1 it is also possible to use several spaced brackets.

Support on the back side is of the essence, for without it the required tensioning force could not be applied. Without the support—such as, for example, in the case of a flexure to the front towards the viewer—the required tensioning forces cannot be applied in every case.

If the image 2 has dimensions which are substantially smaller than the spacing between the two retainer sections 12, so that the image 2 cannot be clamped in the bracket 6, an option in accordance with another solution concept of the present invention is to place such an image between two retainer panels, the external dimensions of which are adapted to the size of the bracket 6 or to the spacing of the retainer sections 12, respectively. The rear retainer panel which faces away from the viewer may herein be either clear, transparent or opaque, and the front retainer panel covering the image is clear and for example of plexiglass or some other clear and elastically deformable material. Both retainer panels are elastically deformable, i.e. flexible. Here it is conceivable that only the one retainer panel located in the rear relative to the viewer may be immobilized between the two retainer sections 12 under a corresponding flexure and in turn include retaining means, e.g. slats or naps at its circumferential edges, whereby the front retainer panel immobilizing the image may be clamped and thus immobilized. Another option is for the two retainer panels to be adapted to be secured, together with the image sandwiched by them, at the bracket 6 between the two retainer sections 12.

Either manner of proceeding will also be suitable particularly if the inherent resetting force of the material of the image 2 is not sufficient for immobilizing the image 2 in the direction of its large surface between the two retainer sections 12. Examples for this are drawings executed on standard drawing paper, newspaper clippings, etc.

As is indicated in phantom line in FIG. 1, the bracket 6 may be provided with supporting struts 7 which additionally stabilize the back side of the image 2 or of a retainer panel.

Figure 2:
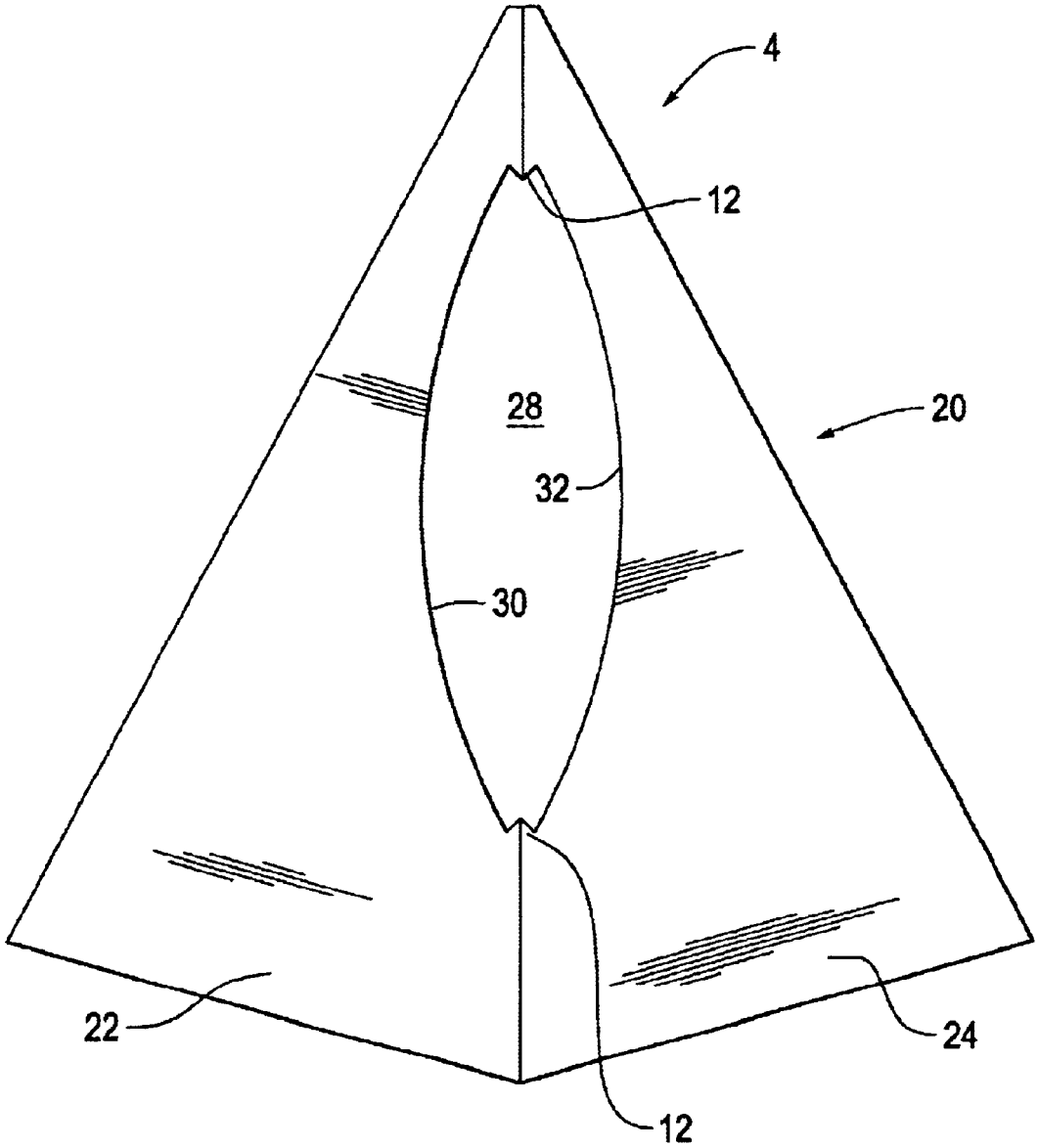
FIG. 2 is a plan view from above of an embodiment of a display body in the spread-out, flat condition.

FIG. 2 shows a device 4 intended in particular for it displaying an image on a planar surface such as, for instance, a desktop or the like. The device 4 essentially consists of a display body 20 which may be conceived of in accordance with FIG. 2 as being made up of two triangles 22 and 24 connected with each other along a line 26. The line 26 thus constitutes the axis of symmetry of the display body 20. Also symmetrically with respect to the line 26, a recess 28 having the form of an elongate ellipse is formed in the display body 20. At each of the upper and lower ends of the recess 28 there is a triangular projection serving as a retainer section 12.

Figure 3:
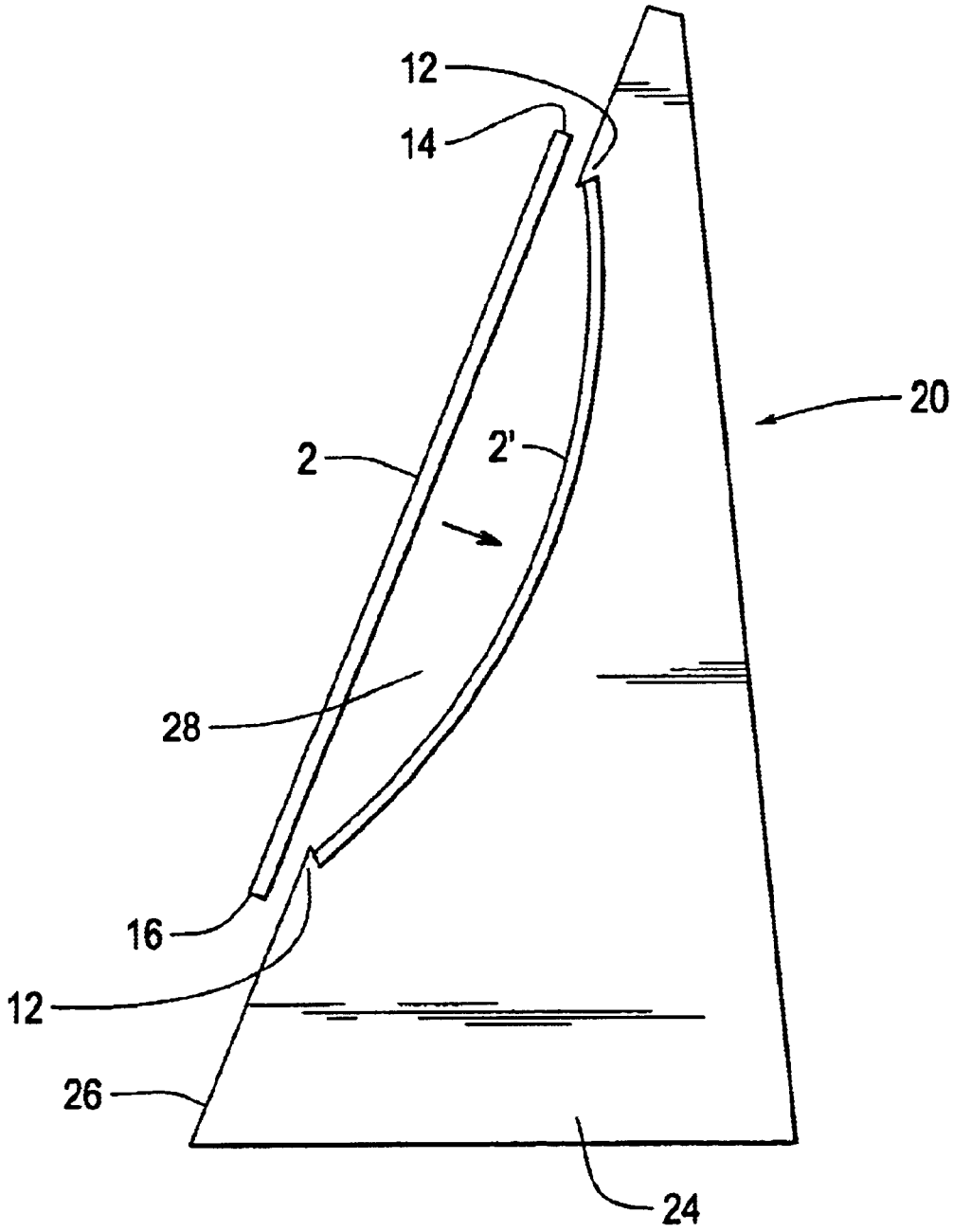
FIG. 3 is a lateral view of the display body of FIG. 2.

The display body 20 in the embodiment of FIG. 2 or FIG. 3, respectively, is preferably fabricated of cardboard, in particular corrugated cardboard. In use, the two triangles 23 and 24 are along the line 26 in FIG. 2 folded towards each other to the rear into the plane of drawing, so that the line of symmetry 26 becomes a projecting edge, as can be seen in the lateral view of FIG. 3. The retainer sections 12 then project in the direction of the recess 28, as can also be seen in FIG. 3. Optionally there are furthermore means not represented in the drawing on the two triangles 22 and 24 in order to stabilize the plied or folded position of the display body 20, in which the bottom edges of the two triangles 22 and 24, which later on will stand on the surface, come to lie on the two sides of a triangle.

As can further be seen in FIG. 3, the spacing between the two retainer sections 12 is smaller than the distance between the two lateral edges 14 and 16 of the image 2. For fastening the image 2 at the display body 20, the image 2 must therefore be flexed until the lateral edge 14 may be grasped by the upper retainer section 12 and until the lower lateral edge 16 may be grasped by the lower retainer section 12, as is seen in FIG. 3 where an image fastened to the display body 20 is designated by reference symbol 2'. The edges 30 and 32 delimiting the recess 28 thus form, in accordance with FIG. 3, arcuate supporting edges between the two retainer sections 12 against which the image 21 may come to lie in its concavely flexed condition, as can be seen in FIG. 3. These two supporting edges 30 and 32, together with the retainer sections 12 and the inherent resetting force of the image 2', make sure that the image 2' is securely clamped on the display body 20.

Figure 4:
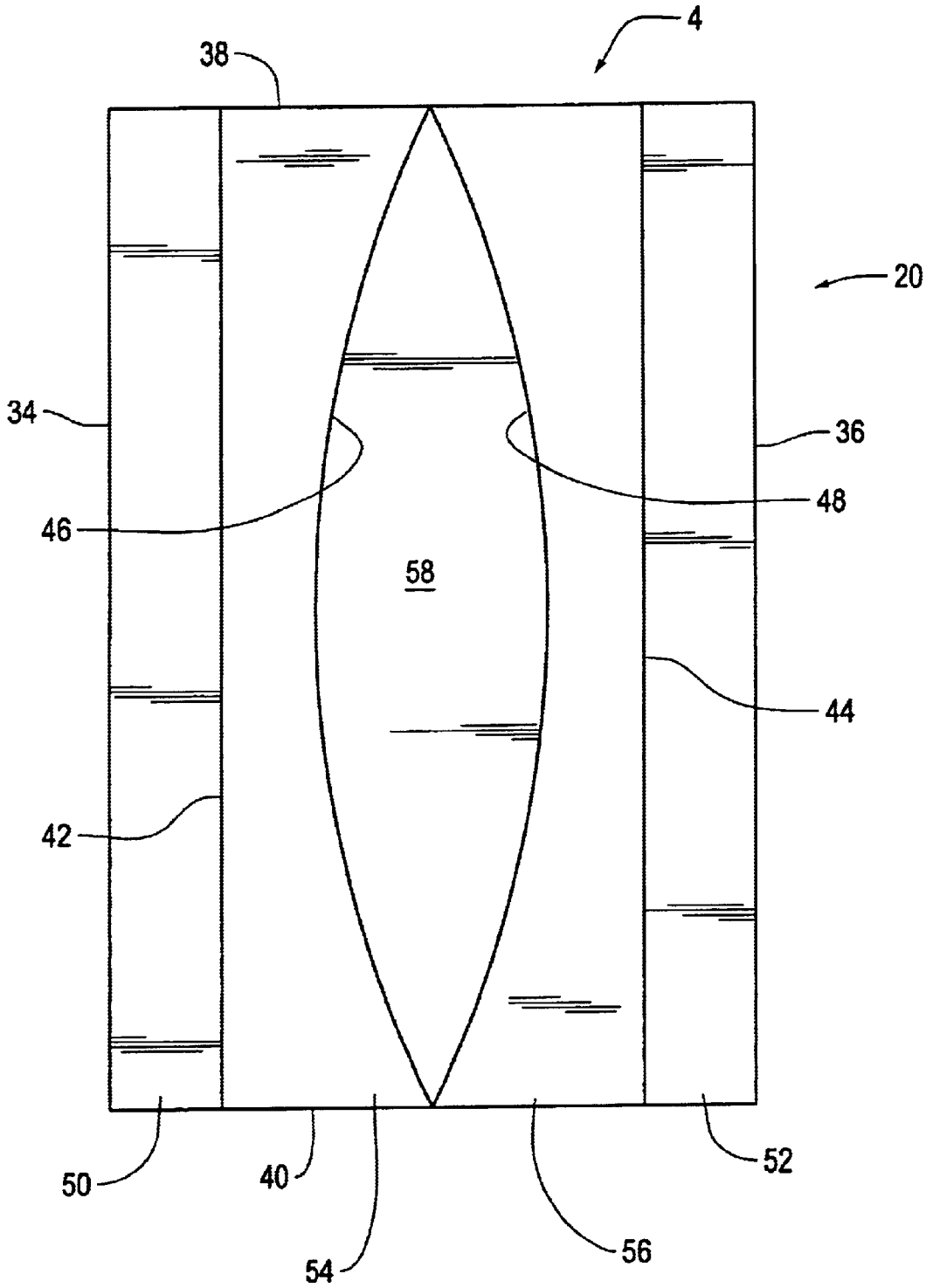
FIG. 4 is a view, corresponding to FIG. 2, of another embodiment of a display body.
Figure 5:
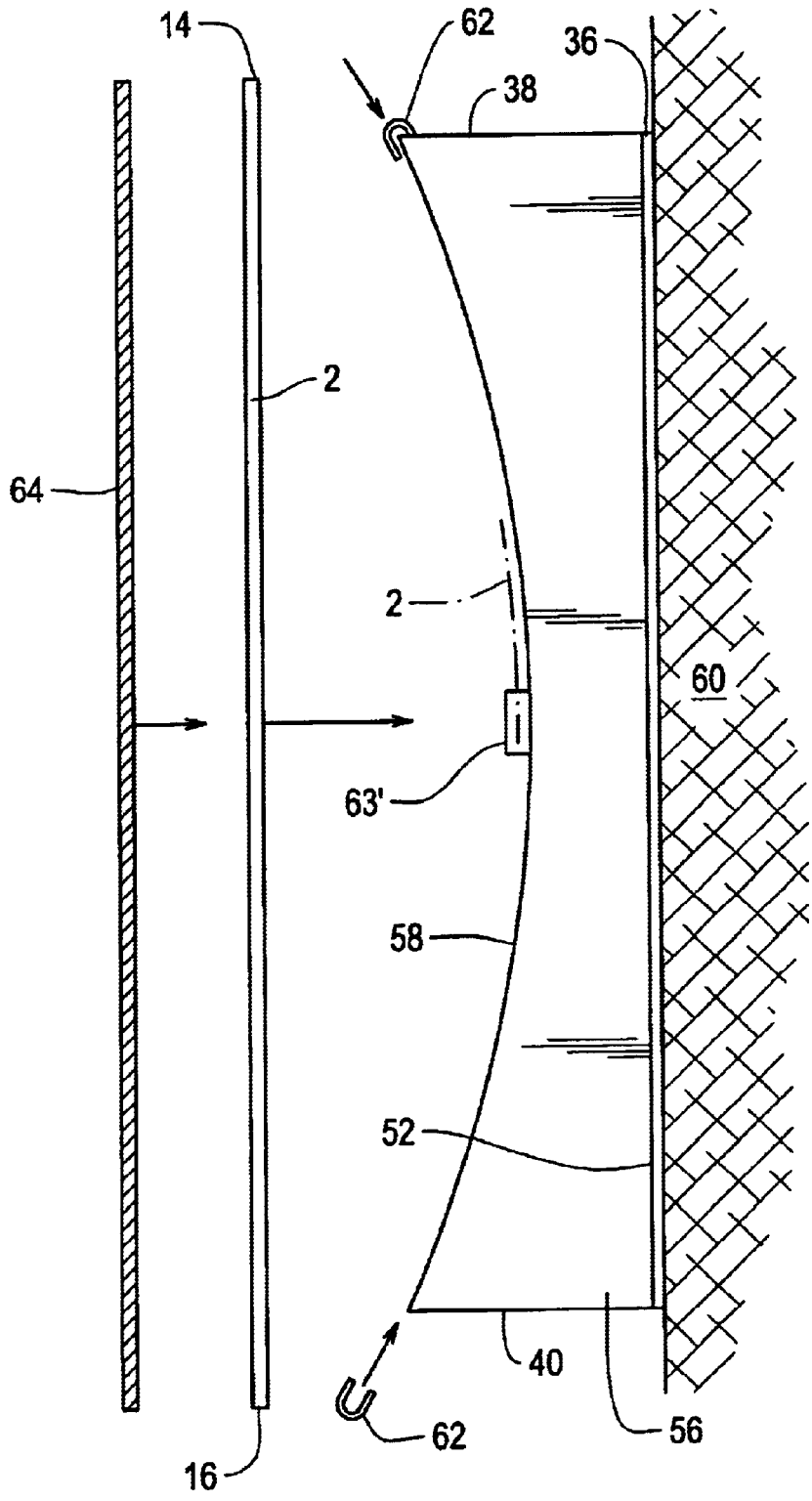
FIG. 5 is a lateral view of the display body of FIG. 4 in use.

FIGS. 4 and 5 show another embodiment of a device 4 according to the invention. FIG. 4 shows a plan view from above of a display body 20 which, in the shown embodiment, is substantially rectangular with two long sides 34 and 36 and two narrow sides 38 and 40. The display body 20 of FIG. 4 is again preferably fabricated of cardboard and here in particular of corrugated cardboard.

At a distance from the two long sides 34 and 36 there extend between the two narrow sides 38 and 40 two folding lines 42 and 44 which are substantially parallel to each other and parallel to the long sides 34 and 36. In a substantially central position in the two narrow sides 38 and 40, two further folding lines 46 and 48 originate which have the elongate/arcuate development shown in FIG. 4 and are symmetrical with respect to an imaginary line extending between the two points of origin at the narrow sides 38 and 40. The folding lines 42 to 48 may, for example, be produced by the material of the display body 20 being weakened in its material thickness by a pressing tool or the like along the folding lines 42 to 48 to be formed later on.

For using the display body 20 represented in FIG. 4, starting out from the flat/extended position in accordance with FIG. 4, the two long sides 34 and 36 are moved towards each other. Formation of the folding lines 42 to 48 is such that one strip 50 between the long side 34 and the folding line 42 and one strip 52 between the folding line 44 and the long aide 36 are folded or bent with respect to one section 54 between the folding line 42 and the folding line 46 and one section 56 between the folding line 48 and the folding line 44. If the process of pushing the two long sides 34 and 36, or strips 50 and 52 located there towards each other is performed such that these remain on a planar support, the sections 54 and 56 are upset in an upward direction or angled relative to the strips 50 and 52 substantially at a right angle from the plane of drawing of FIG. 4, and thus project substantially perpendicularly from the plane of drawing of FIG. 4. At the same time a section 58 between the two folding lines 46 and 48 is angled relative to the two sections 54 and 56 at a substantially right angle, with this section 58 flexing concavely, as can be seen in FIG. 5. optionally in turn securing means are provided whereby the position of the thus formed or folded display body 20 may be stabilized, i.e. whereby the inherent elasticity of the material is prevented from a tendency to move the two long sides 34 and 36 apart again.

The display body 20 of FIGS. 4 and 5 is particularly suited for displaying the image 2 on a wall 60. To this end, the display body 20 includes suitable fastening means whereby it may be fastened on the wall 60. The section 58 between the two folding lines 46 and 48 in accordance with FIG. 5 forms a concavely flexed contact surface extending between the two narrow sides 38 and 40. The spacing between the two narrow sides 38 and 40, in accordance with FIG. 5, is again smaller than the distance between the two lateral edges 14 and 16 of the image 2, so that the latter must be flexed concavely along the extension of the section or surface 5S so as to come to lie flush between the two narrow sides 38 and 40 along the surface 58. Fastening of the image 2 is then achieved with the aid of, e.g., brackets 62 the end sides of which are pushed or inserted over the image 2. In addition, a clear protective sheet 64 for example comprised of plexiglass and substantially matching the flexure of the image may be placed over the image 2, which may then also be fixed with the brackets 62 acting as retainer sections.

In FIG. S an alternative embodiment is indicated by reference symbol 62'. Here the two retainer sections are formed approximately at the lowest point of the concavely curved lateral edges 14, 16, so that the image 2 and/or the retainer panel may be engaged with the retainer sections through application of a force acting about perpendicularly to the large surface, so that the image is also clamped in a concave configuration. This variant may correspondingly be realized in the other embodiments represented in FIGS. 1–11, as well. The retainer sections 62' may have the form of hooks, rotatable eccenters or some other form, so that the image may be tensioned in a simple manner. Instead of support on the lateral edges it is also possible to provide two support surfaces or edges in a position offset from the retainer sections 62'.

Figure 6:
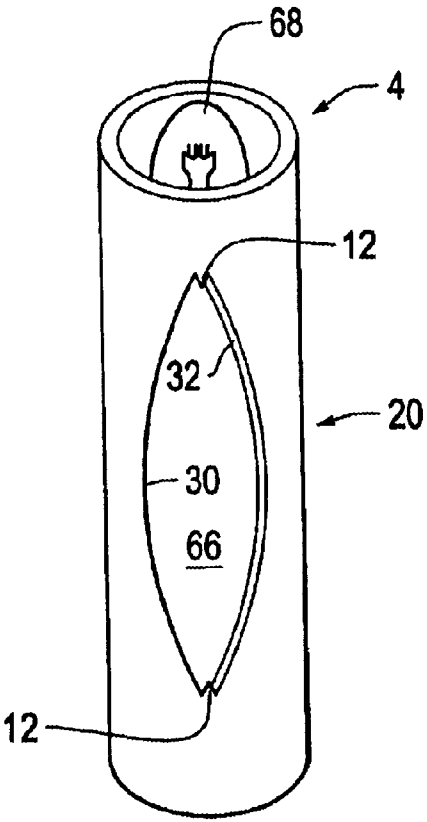
FIG. 6 is a front view of another embodiment of a display body.

FIG. 6 shows another embodiment of a device 4 according to the invention which has a substantially cylindrical hollow display body 20. In the cylinder wall of the cylindrical display body 20 there is a recess 66 substantially matching the shape of the recess 28 in the display body 20 of FIG. 2, i.e., it is elongate/elliptic with two lateral edges 30 and 32 and two end-side projections serving as retainer section 12. Inside the cylindrical hollow display body 20 there may be one or several lighting fixtures 68 having the form of light bulbs, halogen lamps or the like. Depending on type and mounting of the lighting fixtures in or on the display body 20, they serve as direct or indirect light sources, for example in the manner of a so-called ceiling reflecting lamp, or also for directly or indirectly illuminating the image 2 which is held in the recess 66 between the two retainer sections 12 in a concavely flexed configuration and thus lies with its back side against the two edges 30 and 32 of the recess 66.

Figure 7:
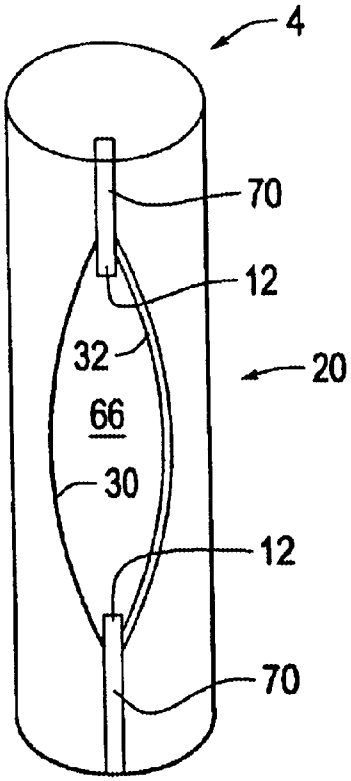
FIG. 7 is a view, corresponding to FIG. 6, of another embodiment of a display body.

FIG. 7 shows another embodiment of a display body 20 of a device 4 according to the invention having the form of a cylinder closed on the end sides. The cylindrical display body 20 in its cylinder or envelope surface again presents the recess 66 corresponding to FIG. 6 and having the two edges 30 and 32. Instead of the triangular retainer sections 12 cut out of the material of the cylindrical wall in accordance with FIG. 6, in the embodiment of FIG. 7 one respective strip or rod 70 is inserted into the cylindrical wall of the display body 20 at the end sides where the two edges 30 and 32 of the recess 66 meet, such that one respective end of a rod 70 projects into the recess 66 and there serves as a retainer section 12. When the display body 20 and the rods 70 are produced of materials of various types or colors, an optically appealing appearance of the display body 20 results.

Figure 8:
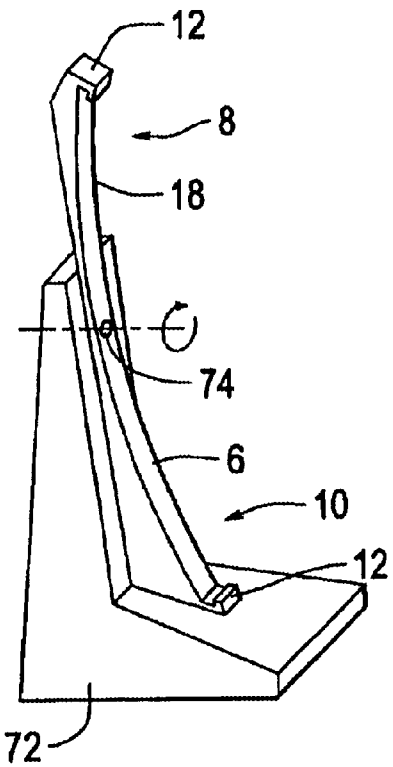
FIG. 8 is another view of an embodiment of a display body according to the invention.

FIG. 8 shows the possibility of rotatingly arranging a bracket 6 on a base body or frame 72. The design of bracket 6 corresponds, for instance, to that of bracket 6 of FIG. 1, i.e., it includes the two legs a and 10 having the end-side retainer sections 12 and the arcuately curved or arcuately extending surface 18. In a central position the bracket 6 is connected to the frame 72 by means of a turning knuckle 74 not represented in detail in FIG. 8. snap-in locking devices may be provided between the bracket 6 and the frame 72 for defining/locking at least two positions of the bracket 6 relative to the frame 72 through catching or the like, namely, a vertical position of the bracket 6 in accordance with FIG. 8, and a horizontal position of the bracket 6 rotated by 90° relative thereto. In the vertical position, images may be clamped upright between the two retainer sections 12, whereas in the horizontal positioning of the bracket 6 the images may be clammed in a crosswise position between the two retainer sections 12.

Figure 9:
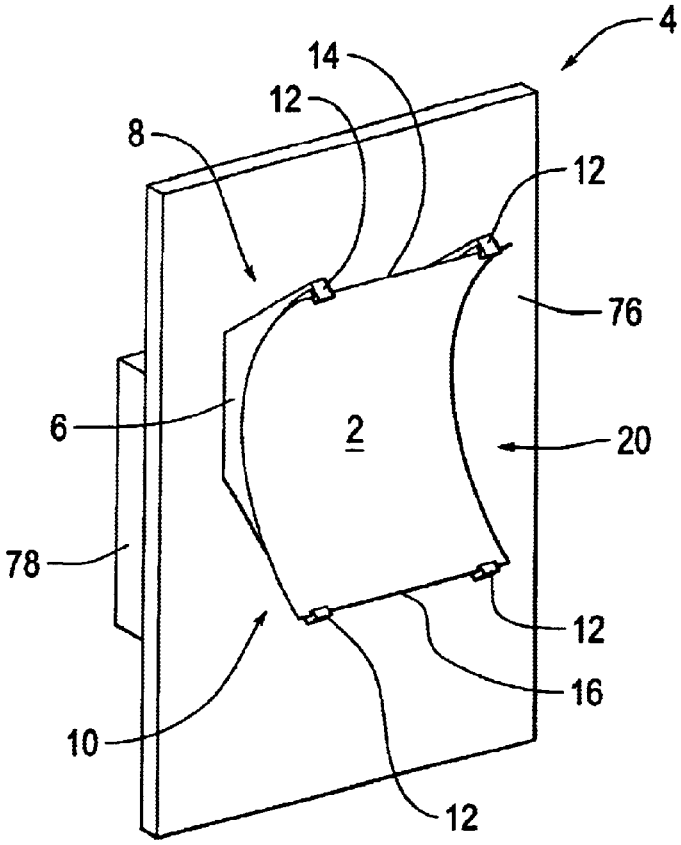
FIG. 9 shows a perspective view of a display body having the form of a wall mount.
Figure 10:
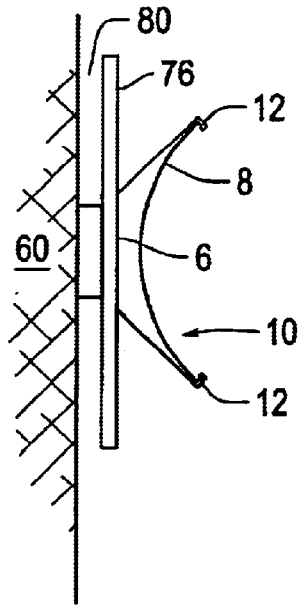
FIG. 10 is a lateral view of the display body of FIG. 9 in a somewhat reduced representation in comparison with FIG. 9.

FIGS. 9 and 10 show perspective and lateral views of another embodiment of a device 4 according to the invention.

The device 4 in accordance with FIGS. 9 and 10 may thus be considered to be substantially composed of three parts, namely, a base panel 76, a spacer 78, and the display body 20 arranged on the base panel 76. The display body 20 is comprised in the represented embodiment of two brackets 6 fastened to the base panel 76 and extending substantially in parallel with each other, which include at the end sides of their two legs 8 and 10 the retainer sections 12 holding the image 2 between themselves. Here, again, the spacing between the retainer sections 12 of a bracket 6 is smaller than the distance between the two lateral edges 14 and 16 of the image 2, so that it is subjected to the concave flexure evident from FIGS. 9 and 10. If retainer panels are used, the retainer sections are inclined relative to the bracket 6 in such a way that the external retainer panel covering the image is subjected to a stronger tensioning force than the internal retainer panel carrying the image. Due to the inclination of the retainer section, the effective distance for the outer retainer panel is practically reduced in comparison with the effective distance for the inner retainer panel, so that reliable clamping is ensured.

The retainer sections may be provided with suitable covers, the geometries of which are adapted to the frame. For example geometrically configured objects of wood, plastic, metal or other materials which are expedient for optical design of the frame may be fastened on the retainer sections 12 by threaded connection or bonding.

Figure 12:
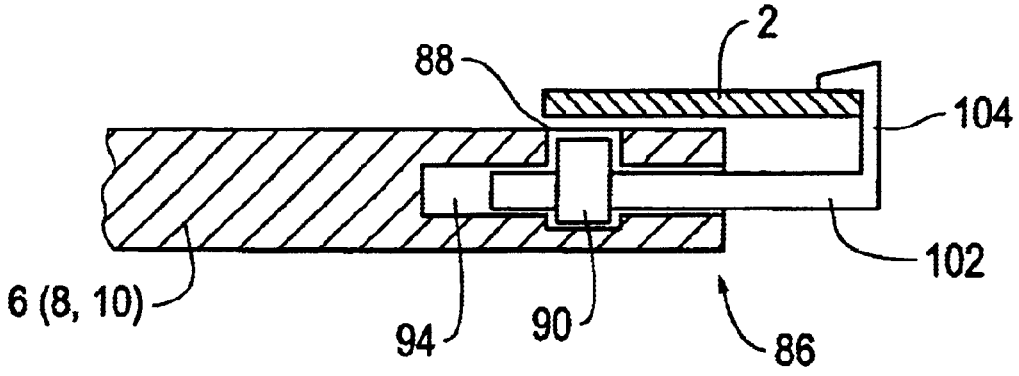
FIG. 12 shows two possibilities for making the spacing of the retainer sections variable.

The design of the retainer sections may in principle be used in all of the embodiments, in particular also in the variant represented in FIG. 12.

FIG. 10 shows mounting of the device 4 on the wall 60, with a space 80 existing between the back side of the base panel 76 and the wall 60 on account of the spacer 78. Due to this space 80, the base panel 76 appears to "soar" in front of the wall 60, so that in conjunction with the concave bulge or flexure of the image 2, and owing to the immobilization of the image 2 by the brackets 6 also at a distance from the base panel 76, an optically interesting, three-dimensional and "soaring" impression of the image 2 is created.

Moreover on a base panel 76 a plurality of brackets 6 may be present in a vertically and/or horizontally adjacent arrangement. Moreover the brackets 6 may also be rotated by 90° relative to the position of FIG. 9 in order to hold an image 2 in a crosswise position between the two lateral vertical lateral edges.

Figure 11:
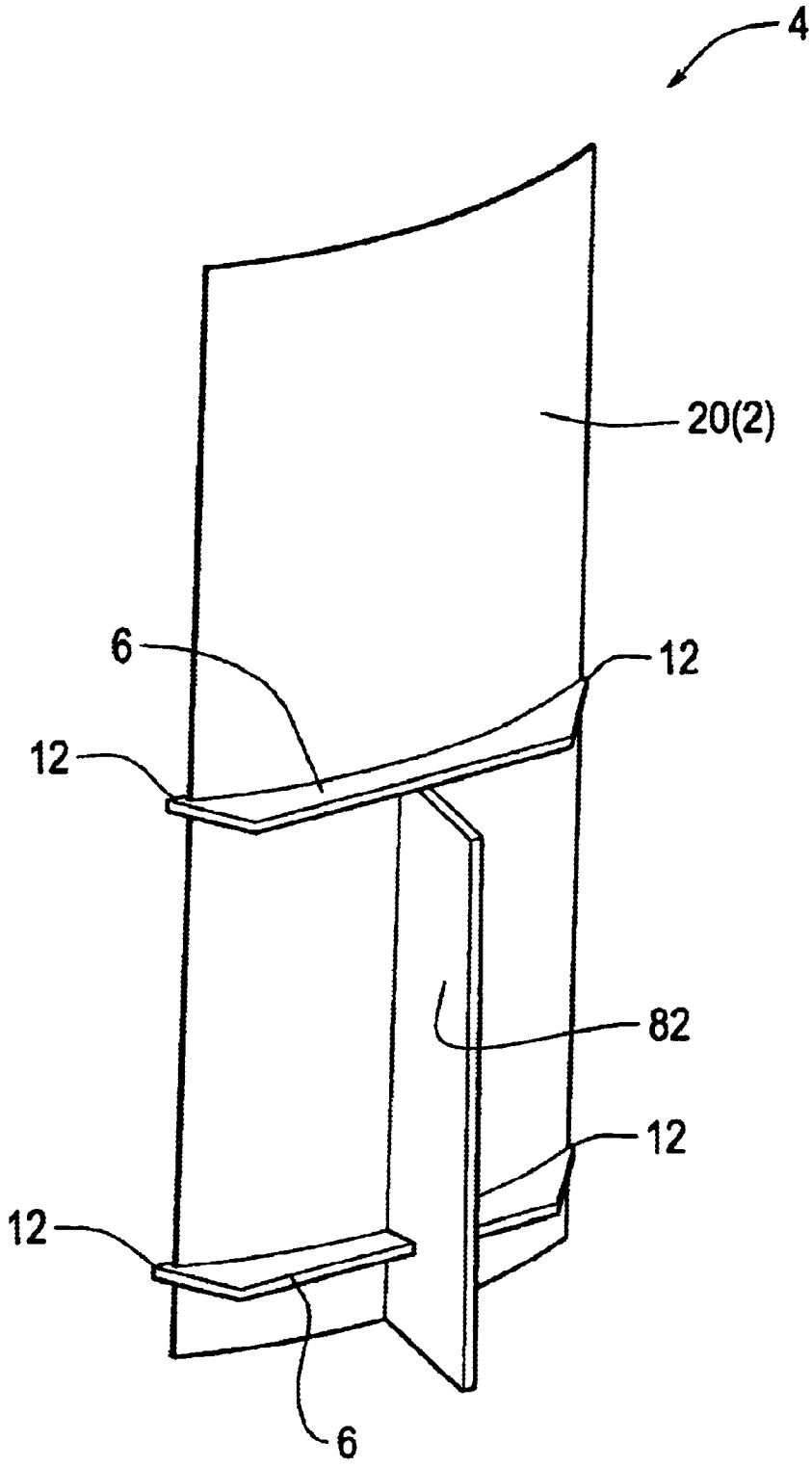
FIG. 11 is a rear view of a display body in accordance with the present invention for placement on a surface.

FIG. 11 shows another embodiment of a device 4 according to the invention in a view from its back side. The device 4 is intended for placement on a planar surface, for example a desktop or the like, and includes a concavely bent display body 20 having on its back side a support 82 as well as a plurality of horizontally extending brackets 6. The support 82 has the function of imbuing the display body 20 with sufficient stability. The brackets 6 provide stiffness for the display body 20 such that it maintains its concave shape. At the end sides, the brackets 6 comprise the retainer sections 12 whereby an image arranged at the front side of the display body 20 is held securely.

In a modification of the device 4 represented in FIG. 11, the latter does not have the concave panel-shaped display body 20 but only consists of the support 82 and the brackets 6 having the end-side retainer sections 12, with the image 2 then being immobilized directly without contact on the concave panel-shaped display body 20 with the aid of the retainer sections 12 and contacting the brackets 6 while being concavely flexed. This is visualized in FIG. 11 by reference symbol 2 in brackets behind the reference symbol 20 for the display body.

The support 82 may furthermore be omitted, so that the image is tensioned only by one or several brackets 6. Due to the curvature of the lateral edges, the image may then be placed on a surface without a support 82, which means that a curved lateral edge of the image or of the retainer panel having the shape of a circular arc then acts as a support surface. This makes it possible to also use the display body as a screen for subdividing spaces etc.

FIG. 12 shows two options of modifying the spacing between the two retainer sections 12 within a certain range to either obtain better adaptation to the image 2 to be clamped, or to modify the tensioning force to be applied to the image 2. Two possible modifications are represented in FIG. 12. At first the possible modification represented on the left in FIG. 12 shall be discussed, wherein an adjustment means 86 is arranged at the free end of each one of the two legs 8 or 10 of the bracket 6, or basically on or in a section of the device 4 at the edge of which the image 2 is to be secured. The adjustment means 86 comprises in accordance with FIG. 12 a body 90 having, for example, a cylindrical shape that is received in a blind bore 88 and through which a threaded recess extends in the radial direction. Such bodies or fittings 90 are, for example, known from furniture manufacture. In the threaded bore of the body 90 there extends a threaded rod 92 which is located in a bore 94 inside the end of the bracket 6 or generally inside the device 4. The one end of the threaded rod or threaded pin 92 located externally of the bore 94 carries another body 96 having, for example, a cylindrical shape which also is in threaded engagement with the threaded pin 92. In accordance with FIG. 12, the upper free end of the body 96 engages a depression 98 in the image 2 or in a base panel carrying the image 2. The extreme free end of the threaded pin 92 presents a slit-type recess or groove 100 for insertion of a screwdriver.

By rotating the threaded pin 92 it may be screwed into or out of the body 90, and moreover by rotating the body 96 relative to the threaded pin 92, the former may also be moved back and forth along the threaded pin 92.

As an alternative, the body 96 engaged in the depression 98 may be mounted on the threaded pin 92 so as to be only rotatable, however not in threaded engagement with it, so that an adjustment of the threaded pin 92 or of the body 96 only takes place through threaded engagement between the pin 92 and the body 90.

By correspondingly rotating the threaded pin 92 it is thus possible in either one of the two construction versions to adjust the position of the body 96 relative to the bracket 6 and thus the tension applicable to the image 2 within a certain range. With the aid of this mechanism, it is thus possible to perform clamping of the very image or in turn adjust the tensioning force.

In the embodiment represented on the right in FIG. 12, the body 90 provided with the radial thread is again arranged in the blind bore 88 in analogy to the left side. The body 90 or its threaded bore is engaged by a component 102 which extends in the bore 94 and at its external free end presents a hook-shaped retainer section 104 which encompasses the image 2 either by itself or together with the retainer panels located above or below the image 2. In the case of the possible modification represented on the right in FIG. 12, as well, the tensioning force applicable to the image 2 and/or the two retainer panels may be adjusted by rotating the component 102 relative to the body 90 and thus screwing it out of the bracket 6 or into the latter.

Another possibility of adjusting the tensioning force applicable to the image 2 and/or the retainer panels is, for example, to provide the arrangement in accordance with FIG. 12 (both left and right possible modification) with an eccenter whereby a retainer body (analogous with body 96) or a retainer section (analogous with retainer section 104) may be adjusted relative to the bracket 6 or the device 4 in general.

Use of the protective sheet 64 in accordance with FIG. 5 is, of course, also possible in the other embodiments shown in the drawing and disclosed in the description. Moreover the protective sheet 64 may have on its surface facing the image 2 or facing away from it (or congruously on both surfaces) a continuous peripheral border blocking the view, which then creates a passe-partout effect. The border may be adhered of toil, applied with paint, or cut from paper, carton, metal foil or plastic foil having a prefabricated frame or passe-partout shape and placed between image 2 and protective sheet 64. The protective sheet 64 itself may then also have the form of a passe-partout.

The flexure of the image 2 and of the optionally provided protective sheet 64 has in one embodiment a radius of curvature corresponding to about 2 to 3 times the length of the long side of the image. Practical experimentation has shown that radii of curvature in the range of 2–4 m have a particularly appealing (three-dimensional) effect on the viewer in the case of images with a customary size.

If it is desired to subsequently mount the image 2 clamped in the device 4 with a frame or a frame-like material, such frames may be produced in sections. "Sections" in this context is to signify that, for example, in the embodiment of FIG. 9 two straight frame portions or frame slats having corresponding brackets may be inserted over or snapped on the two opposite lateral edges 14 and 16 of the image 2. The two remaining, opposite and concavely flexed lateral edges of the image 2 may equally be covered with correspondingly bent frame slats or the like which are also inserted over or snapped on these two lateral edges. This variant is particularly advantageous or applicable whenever the image 2 is present not by itself but sandwiched between the two retainer panels or together with the front cover panel 64 in accordance with FIG. 5, for in this case sufficiently stable material for insertion or snapping on of the frame components is provided. The frame components themselves may have any desired coloring, shape and cross-section, may be of material matching the display body or contrasting with it, and abut or are joined at the corner points of the image 2.

In a simplified form of the device according to the invention, only the rear retainer panel is clamped between the retainer sections 12 and the cover panel 64 and optionally the image is secured to the retainer panel. It would, of course, also be possible to secure the retainer panel to the retainer panel jointly with the image and the cover panel 64.

An essential principle of the invention must be seen in the fact that the two retainer sections clasping the back side of the image are arranged at such a spacing that the image and/or the retainer panels may at first be arranged in a configuration convexly flexing towards the viewer, and then reverse into the concave shape by application of a force onto the apex of the image or of the retainer panels while being supported in the rear, so that they are reliably clamped through this three-point clamping (two retainer sections, rear support).

In an alternative variant, the image is taken into surface contact with one or several supporting surfaces by the retainer sections, whereby the concave clamped position is created. I.e., in the first-mentioned concept the tension is applied by way of the retainer sections, such as in the direction of the large surface, whereas in the latter case it is applied at a right angle to the direction of the large surface.

The concept of the invention may in principle be employed in any display bodies wherein a planar specimen is received.

A display body or picture frame is disclosed wherein an image or a retainer panel supporting the image is received between two retainer sections formed at a rear bracket and pre-tensioned against a rear support, so that it is clamped in a concave configuration towards the viewer.

What is claimed is:

1. A picture frame for images, including a display body holding an image or a retainer panel located behind the image, wherein said display body includes at least one bracket that clasps said image or said retainer panel from a rear portion of said image or said retainer panel, said bracket provides stiffness for said image or said retainer panel, two retainer sections are formed on said bracket and each retainer section has a retainer edge to clamp said image or said retainer panel essentially between said two retainer edges, via which said image or said retainer panel is concavely curved towards a viewer, with a back side of said image or said retainer panel being supported at a support in a range of its flexture relative to said display body in at least one support location at least outside an area defined by said retainer edges and separate from said retainer sections.

2. The picture frame in accordance with claim 1, wherein the at least one support location is at least one supporting edge, and the back side of said image or of said retainer panel located behind said image is supported against said display body in the range of the flexure thereof along the at least one supporting edge extending between two lateral edges of said image or of said retainer panel.

3. The picture frame in accordance with claim 2, wherein two supporting edges extend substantially in parallel to each other.

4. The picture frame in accordance with claim 2, wherein said two supporting edges each originate in the retainer sections or end there, respectively, and in between have an arcuately curved development.

5. The picture frame in accordance with claim 1, wherein said retainer sections are opposite to each other and a distance between said retainer sections is variable.

6. The picture frame in accordance with claim 1, wherein a clear protective sheet may be placed in front of said image, which substantially matches the flexure of said image and jointly with said image may be immobilized at said retainer sections of said display body.

7. The picture frame in accordance with claim 6, wherein a radius of curvature of said image and of said at least one retainer panel and of said protective sheet is about 2 to 3 times the length of a long side of said image, preferably between 2 and 4 m.

8. The picture frame in accordance with claim 1, wherein a radius of curvature of said image and of at least one retainer panel is about 2 to 3 times the length of a long side of said image, preferably between 2 and 4 m.

9. The picture frame in accordance with claim 1, wherein said retainer sections support said image or said retainer panel along point-type or linear areas.

* * * * *